US007913877B2

(12) United States Patent
Neuhalfen

(10) Patent No.: US 7,913,877 B2
(45) Date of Patent: Mar. 29, 2011

(54) AEROSOL MOUNTING CUP FOR CONNECTION TO A COLLAPSIBLE CONTAINER

(75) Inventor: Mark Neuhalfen, Mt. Prospect, IL (US)

(73) Assignee: Aptargroup Inc., Cary, IL (US)

( * ) Notice: Subject to any disclaimer, the term of this patent is extended or adjusted under 35 U.S.C. 154(b) by 207 days.

(21) Appl. No.: 10/762,003

(22) Filed: Jan. 21, 2004

(65) Prior Publication Data

US 2005/0155980 A1 Jul. 21, 2005

Related U.S. Application Data

(60) Provisional application No. 60/441,438, filed on Jan. 21, 2003.

(51) Int. Cl.
*B65D 35/28* (2006.01)

(52) U.S. Cl. ..... 222/95; 222/402.1

(58) Field of Classification Search ..... 222/95, 222/105, 107, 313, 386.5, 542, 402.1, 402.21, 222/402.23; 141/3, 20, 18, 114; 220/915
See application file for complete search history.

(56) References Cited

U.S. PATENT DOCUMENTS 3,169,670 A * 2/1965 Hrebenak et al. ..... 222/95
3,245,582 A 4/1966 Roth et al.
3,322,590 A 5/1967 Clark
3,477,195 A * 11/1969 Chambers ..... 53/470
3,558,397 A 1/1971 Clark
3,662,926 A * 5/1972 Umstead ..... 222/95
3,690,524 A 9/1972 Haberhauer
3,770,165 A 11/1973 Steinman et al.
3,823,849 A 7/1974 Ruscitti
3,940,026 A * 2/1976 Kain ..... 222/212
3,986,641 A * 10/1976 Casey ..... 222/95
3,992,003 A 11/1976 Visceglia et al.
4,023,607 A 5/1977 Jensen et al.
4,098,220 A * 7/1978 Yuhas ..... 116/106
4,121,737 A * 10/1978 Kain ..... 222/95
4,185,758 A * 1/1980 Giggard ..... 222/386.5
4,293,353 A * 10/1981 Pelton et al. ..... 156/69
4,346,743 A * 8/1982 Miller ..... 141/3
4,375,743 A * 3/1983 Sullivan ..... 53/434
4,405,065 A * 9/1983 Beard ..... 222/153.11
4,425,177 A 1/1984 Shinno
4,452,378 A 6/1984 Christine
4,484,351 A 11/1984 de Leeuwe et al.
4,513,889 A * 4/1985 Beard ..... 222/153.07
4,732,299 A 3/1988 Hoyt
4,949,871 A * 8/1990 Flanner ..... 222/95
5,031,384 A * 7/1991 Rebeyrolle et al. ..... 53/452
5,115,944 A 5/1992 Nikolich
5,125,546 A 6/1992 Dunne et al.
5,190,184 A * 3/1993 Lechner ..... 220/581
5,211,316 A 5/1993 Adalberto et al.
5,261,571 A 11/1993 Goncalves (Continued)

*Primary Examiner* — Lien T Ngo
(74) *Attorney, Agent, or Firm* — Frijouf, Rust & Pyle, P.A.

(57) ABSTRACT

An improved mounting cup is disclosed for dispensing an aerosol product from a collapsible container within an aerosol container. The improved mounting cup comprises a peripheral rim located in proximity to an outer periphery of the mounting cup for sealing the mounting cup to the aerosol container. A turret is located in proximity to an inner periphery of the mounting cup for receiving an aerosol valve for dispensing the aerosol product from the collapsible container. A mounting surface is located intermediate the peripheral rim and the turret for securing the collapsible container to mounting cup.

9 Claims, 13 Drawing Sheets

U.S. PATENT DOCUMENTS 5,265,765 A * 11/1993 Maier ..... 222/105
5,275,311 A 1/1994 Piarrat
5,277,336 A * 1/1994 Youel ..... 222/105
5,324,233 A 6/1994 Owensby et al.
5,454,488 A 10/1995 Geier
5,511,697 A 4/1996 Gruenbacher et al.
5,522,526 A * 6/1996 DeLaforcade et al. ..... 222/1
5,540,358 A 7/1996 Wiles et al.
5,564,591 A 10/1996 Christine et al.
5,617,978 A 4/1997 Geier
5,630,530 A 5/1997 Geier et al.
5,699,936 A 12/1997 Sakamoto
5,819,986 A 10/1998 Last et al.
5,819,987 A 10/1998 Miller
5,823,383 A 10/1998 Hins
5,873,491 A 2/1999 Garcia et al.
5,875,939 A 3/1999 Geier
5,919,360 A 7/1999 Contaxis, III et al.
5,957,333 A * 9/1999 Losenno et al. ..... 222/95
5,971,214 A * 10/1999 Bettison, Jr. ..... 222/153.11
5,971,613 A 10/1999 Bell
6,000,848 A 12/1999 Massioui
6,007,884 A 12/1999 Nittel
6,050,451 A 4/2000 Hess, III et al.
6,070,763 A * 6/2000 Gueret ..... 222/95
6,085,945 A 7/2000 Fransen
6,142,344 A 11/2000 Kai
6,196,275 B1 * 3/2001 Yazawa et al. ..... 141/3
6,230,943 B1 * 5/2001 Miyamoto et al. ..... 222/394
6,250,505 B1 * 6/2001 Petit ..... 222/95
6,345,739 B1 * 2/2002 Mekata ..... 222/389
6,352,182 B1 * 3/2002 Gueret ..... 222/321.9
6,375,049 B1 4/2002 Geier
6,439,430 B1 * 8/2002 Gilroy et al. ..... 222/95
6,581,807 B1 * 6/2003 Mekata ..... 222/402.1

* cited by examiner

AEROSOL MOUNTING CUP FOR CONNECTION TO A COLLAPSIBLE CONTAINER

CROSS-REFERENCE TO RELATED APPLICATIONS

This application claims benefit of U.S. Patent Provisional application Ser. No. 60/441,438 filed Jan. 21, 2003. All subject matter set forth in provisional application serial number Jan. 21, 2004 is hereby incorporated by reference into the present application as if fully set forth herein.

BACKGROUND OF THE INVENTION

1. Field of the Invention

This invention relates to dispensing of an aerosol product and more particularly to an improved mounting cup for dispensing the aerosol product from a collapsible container within an aerosol container.

2. Description of the Related Art

An aerosol dispenser comprises an aerosol product and an aerosol propellant contained within an aerosol container. An aerosol valve is provided to control the discharge of the aerosol product from the aerosol container through the fluid pressure provided by the aerosol propellant.

The aerosol valve is biased into a closed position. A valve stem cooperates with the aerosol valve for opening the aerosol valve. An actuator engages with the valve stem to open the aerosol valve for dispensing an aerosol product and the aerosol propellant from the aerosol container. The aerosol product and the aerosol propellant are dispensed from the aerosol valve through a spray nozzle. Typically, the aerosol product and the aerosol propellant are contained in a common portion of the aerosol container.

Some in the prior art have incorporated an inner container for receiving the aerosol product to separate the aerosol product from the aerosol propellant. In general, the inner container was a flexible container secured to the aerosol valve. The inner container was located within the aerosol container with the aerosol propellant disposed externally inner container. The aerosol propellant applied pressure to the exterior of the inner container to dispense only the aerosol product from the aerosol valve through the spray nozzle.

The following U.S. patents represent certain attempts of the prior art to provide an inner container for receiving an aerosol product and for separating the aerosol product from an aerosol propellant.

U.S. Pat. No. 3,992,003 to Visceglia et al. discloses an aerosol container having sealed propellant means comprising a flexible propellant bag having air or inert gases under pressure and a predetermined quantity of product located within the container. In a first embodiment, the propellant bag is fixedly mounted at the outlet and includes a separate valve for loading of the pressurized gas. A second valve is mounted at the outlet and is connected to a perforated tube which extends downwardly into the container to emit product when the valve stem is depressed. Actuation of the valve stem causes the propellant bag to expand forcing the product out through the valve. In a second embodiment, the container includes a plurality of product bags which are mounted to a valve arrangement at the outlet and a pressurized propellant which is forced into the container to maintain the product bags under pressure. The valve arrangement comprises a separate valve for each product bag and a valve for loading the propellant into the container tube. The product valves are connected to a mixing cap to emit a predetermined spray when the cap is depressed. In both embodiments of the invention, the propellant is not emitted with the spray and in instances where fluorocarbons are used this is an important ecological advantage.

U.S. Pat. No. 4,484,351 to de Leeuwe et al. discloses a storage container formed by joining together the sides and top of a pair of matched laminated flat sheets. The bottom portions are joined together adjacent the sides. The center is sealed along the sealing surfaces of a tube connector assembly. The connector portion is in the form of a parallel pipe head the center of which is enclosed a tube. The tube extends through the connector and projects outwardly therefrom to provide a closable access path for filling and draining the container. The projected portion of said tube is corrugated. A sleeve is formed along the top edge of the sealed top portion of sealed container and a stiffener rod is installed in the sleeve to provide a more stable structure for handling when the container is filled. Below the sleeve and horizontally centered is a hook mounting aperture for holding the container in the drain position. Disposed symmetrically on opposite sides of said hook mounting aperture are a pair of gripping apertures which facilitate handling of the container. At the bottom are a pair of sealed flaps disposed on each side of said tube projection and within each flap is an aperture. These apertures are used to hold a container during the filling cycle. A shut-off cap is a tubular structure and has a wide section, the interior of which fits over the tube projection and a narrow section. The interior walls of said wide section are corrugated so that a fluid tight fit is obtained when installed on said tube projection. A membrane seals the shut-off cap and is formed at the junction of the wide and narrow sections of said shut-off cap. A dust cover is attached by a flexible lead and is designed to fit over a part of the narrow section, thus preventing dust and other contaminants from getting into the narrow tube during storage and transport.

U.S. Pat. No. 4,732,299 to Hoyt discloses a collapsible container which has a first pliable member and a second non-pliable member. The first pliable member includes a first pliable sheet and a second pliable sheet which are joined together to form a pouch to hold the contents. The second non-pliable member includes a base design allowing for leak-free seals with the pliable sheets and a stem having a passageway with an outlet for dispensing the contents of the pouch.

U.S. Pat. No. 5,275,311 to Piarrat discloses the dispensing packagings for viscous, creamy or paste products, as well as a manufacturing method for these dispensing packagings. The body of the packaging according to the invention, in substance tubular, comprises an interior envelope, apt for containing the product to be dispensed, and an exterior envelope capable of yielding to the pressure and then to regain, in substance, its initial form. These two envelopes are coupled and united according to a line parallel, in substance to the axis of the body. The tubular body thus formed is then welded, by one of its extremities, to a dispenser head, the other extremity being closed by a weld or placed on a base. The packaging according to the invention applies notably to cosmetic products, to health care products and to technical products.

U.S. Pat. No. 5,511,697 to Gruenbacher et al. discloses a reclosable pouch package for dispensing a product having a fitment in a folded end of the pouch. A substantially rigid fitment has an inner end, an outer end, and an orifice therethrough extending from the inner end to the outer end. The fitment also has a planar flange at the inner end. The pouch is formed from a substantially rectangular piece of thermoplastic film. The piece of film has a hole therein. Around the hole a depression is formed in the film either by thermoforming or cold forming. The depression is sized such that when the flange of the fitment is bonded to the film at the hole, and the piece of film is folded away from the fitment and fin-sealed closed, the folded end of the resulting pouch has minimal concavity and the pouch has parallel side seals.

U.S. Pat. No. 5,540,358 to Wiles et al. discloses a flexible package for dispensing a product through a fitment. The package has a planar enclosed body extending between a bottom end and a top end. The package further includes a planar gusset panel sealed to the body at the top end. The gusset panel is sealed to the body such that the package can be folded so that the gusset panel will lie flat against and in the same plane as the body of the package. The gusset panel further includes an aperture disposed therein. A dispensing fitment extends through the aperture on the gusset panel for dispensing.

U.S. Pat. No. 5,630,530 to Geier et al. discloses a dispensing module for use in the dispensing of pressurized liquids, foams, gels or the like comprising a dispenser valve and a flexible bag which is bonded thereto. The bag is intended to be located within an outer container by way of an opening in the latter that can be closed with a lid. Disposed within the bag is a delivery nozzle that can be connected to the valve body of the dispenser valve through the bag material with the interposition of a sealing ring in such a way that between the interior of the bag and the valve body fluid communication is maintained. The delivery nozzle and/or the valve body is made of a material that is fracture-proof and in particular not permeable to organic media. The portion of the delivery nozzle immediately adjacent to the bag is provided with a surface or a covering of a material, such as polyethylene, polypropylene or polyamide, which can be bonded to the bag material.

U.S. Pat. No. 5,699,936 to Sakamoto discloses a liquid container/dispenser including a container body defining a flexible wall for storing a liquid and a tube member having a first end portion placed outside the container body and a second closed end portion placed inside the container body. The tube member has as an opening device provided in the second closed end portion of the tube member inside the container body. The second closed end portion can be broken off from the rest of the tube member inside the container body by a force applied through the wall of the container body. The wall of the container body is preferably made from a flexible material so that the wall can be flexibly brought into contact with the tube member inside the container. The liquid container with the novel dispensing system assures the sealed storage of liquid in the container and yet facilitates clean, quick and safe dispensing of the liquid.

U.S. Pat. No. 5,819,986 to Last et al. discloses a dispenser for liquid, gel, granular or powdered media comprising an outer container of rigid material in which a suction pump is operated by a trigger mechanism. A pump outlet is connected via a flexible tube to a spray nozzle, and via a suction tube to a connector tube. A refill packing is provided within the outer container and includes an integrally manufactured connector that can be pressed onto the connector tube. The connector tube opens the connector upon insertion thereinto. A special plug, including guide arms, ensures that the connector opens upon insertion of the connector tube, and closes again upon withdrawal of the connector tube from the connector. The connector connector tube assembly provides leak-free connection of the refill packaging within the outer container.

U.S. Pat. No. 5,819,987 to Miller discloses an apparatus for dispensing multiple fluids from nested containers, while simultaneously venting the fluid containers, including a first container for containing a first fluid, a second container, nested within the first container, for containing a second fluid, and a manually operable pump for pumping fluid from the containers to dispense a mixture of the fluids from the apparatus. The pump includes a pump actuator for actuating and deactuating the pump, a reciprocating fluid conduit, which reciprocates upon actuation and deactuation of the pump actuator and a discharge nozzle for dispensing the mixture of the fluids from the apparatus upon actuation of the pump. The apparatus also includes a mixing chamber for mixing the first and second fluids drawn from the first and second containers, respectively, a fluid transfer conduit for withdrawing fluid from the first container into the mixing chamber and a fluid transfer mechanism for withdrawing fluid from the second container into the mixing chamber, the fluid transfer mechanism including an auxiliary pump, attached to the reciprocating conduit, for pumping fluid from the second container to the mixing chamber upon a corresponding reciprocation of the reciprocating conduit.

U.S. Pat. No. 5,823,383 to Hins discloses a plastic weld pourer component for connecting to a plastics container part, more particularly a container part of film-like plastics material, comprising at least one welding rib extending circumferentially about a neck portion defining a discharge passage, and having a welding edge or fact. The welding edge is provided at a welding flash formed on a rib base portion of the welding rib having a smaller dimension in directions perpendicular to the circumferential direction than that of the rib base portion.

U.S. Pat. No. 5,873,491 to Garcia et al. discloses a set of components for assembly as a dispensing package for an aerosol product. A collapsible bag is provided for holding the aerosol product. The collapsible bag is attached to a support which in turn is mounted within a hollow body. A retention member holds a finger-operable pump to the support for communication with the interior of the bag.

U.S. Pat. No. 5,919,360 to Contaxis, III et al. discloses an additive dispensing apparatus for an acrid system which includes a head having a body portion adapted and configured for fluid communication with the fluid system and having a flow path extending therethrough. A fluid inlet portion of the flow path defines a relatively high pressure region and a fluid outlet portion of the flow path defines a relatively low pressure region. A canister is operatively associated with the body portion and structure is provided for facilitating fluid communication between the fluid inlet portion and the interior of the canister. A collapsible container is disposed within the canister for containing a liquid additive for dispensement into the fluid system and structure is provided for facilitating fluid communication between the collapsible container and the fluid outlet portion, whereby the differential pressure between the interior of the canister and the interior of the collapsible container effectuates a proportional dispensement of liquid additive into the fluid system.

U.S. Pat. No. 5,971,613 to Bell discloses a bag construction including first and second opposed panel sections. Each of the panel sections have first and second opposite side edges. The panel sections are secured to one another along at least a portion of the first and second opposite side edges by first and second side seals, to define a bag construction interior. The first and second side seals each have an inner edge portion adjacent to the bag construction interior. The first side seal inner edge portion has at least one non-linear edge section extending over a part of the first side seal inner edge portion. The non-linear edge may include an edge with a plurality of spaced inwardly directed projections, or as edge with curved portions, or an undulated edge. The seals may be used in a variety of packaging arrangements, and help to provide an arrangement which will stand upright when filled or at least partially filled with material.

U.S. Pat. No. 6,000,848 to Massioui discloses a closure for a self-standing pouch designed to hold fluid, which closure includes a fitment, having a base and either an integral or removable stem, which stem carries an integrated cap. The closure may also include a straw that extends downward into the fluid and above the stem or at least a mouthpiece. A straw like member in place of a straw can be integral to the fitment, or threadable or otherwise attachable thereto. The fitment aspect may be one piece or two as noted, and if two, is adapted to permit the refilling of the pouch as may be desired. The closure may be placed at various locations on a fluid containing pouch.

U.S. Pat. No. 6,007,884 to Nittel discloses a method for manufacturing flexible plastic containers by two die molds, in the connecting seam of which at least one insert for filling and/or emptying the container is introduced comprising press faces running perpendicular to the wall of the container. The angle of the press faces is greater than 90°, preferable nearly 180° at each locus of connection to the die molds, with regard to the connecting seam of the two die molds.

U.S. Pat. No. 6,050,451 to Hess, III et al. discloses a dispensing structure, and a package with a dispensing structure, provided with a valve. In one embodiment, the dispensing structure is a multi-piece fitment. The multi-piece fitment includes a base for mounting to the container and a valve carrier for mounting to the base. A flexible self-sealing slit-type valve is mounted within the carrier. In another embodiment, a fitment is mounted in the opening of a thin-walled flexible collapsible container, and the flexible valve is mounted in the fitment. In yet another embodiment, a package includes a container having a corner wall defining an opening and a fitment is sealingly mounted to the corner wall at the opening. A valve is disposed within the fitment. A removable and disposable cover extends from the container over the fitment and at least a portion of the corner wall to define a hermetically sealed volume around the fitment. The cover may be pulled away from the container to expose the fitment.

U.S. Pat. No. 6,142,344 to Kai discloses a package body provided with a spout which is welded to an inner surface of a mouth portion of the body. The spout has an outer periphery of a welding part having a curved outer surface of a boat shape in a plan view at a seat, and the outer periphery of the welding part is welded to the inner surface of the mouth portion. The spout includes a projected piece at an outer periphery above the seat. The package body is accommodated within a housing provided with a casing openable about a hinge. The body is arranged within the casing in an opened state, with the spout being directed upwardly, and then the casing is closed to accommodate the package body. The spout is fixed by a fixture which is dividable into two halves with a center hole. This hole has a groove for fixing the projected piece of the spout from the outside in the combined state of the spout fixture, and with a curved surface for fixing the periphery of the spout. The spout fixture is provided with projecting rows at an outside portion which is fixed to the supporting hole. These projecting rows are fitted into concave row grooves formed in the inner wall of an opening portion defined at the upper portion of the casing, and by closing the casing the package body is accommodated within the casing and the spout is fixed.

Therefore, it is an object of the present invention to provide an improved mounting cup for dispensing an aerosol product from a collapsible container within an aerosol container having an improved apparatus and method of securing the collapsible container to the mounting cup.

Another object of this invention is to provide an improved mounting cup for dispensing an aerosol product from a collapsible container wherein the aerosol propellant is inhibited from contacting the aerosol valve.

Another object of this invention is to provide an improved mounting cup for dispensing an aerosol product from a collapsible container wherein the aerosol propellant is prevented from permeating through the aerosol valve.

Another object of this invention is to provide an improved mounting cup for dispensing an aerosol product from a collapsible container wherein the aerosol product may be high speed pressure filled into the collapsible container.

Another object of this invention is to provide an improved mounting cup for dispensing an aerosol product from a collapsible container that may be utilized with virtually any type of aerosol valve without the need of a special aerosol valve design or an adapter for attachment to the aerosol valve.

Another object of this invention is to provide a method of securing a collapsible container to a mounting cup through the use of a polymeric material located between the collapsible container and the mounting cup.

Another object of this invention is to provide a method of securing a collapsible container to a mounting cup wherein the collapsible container is bonded to the mounting cup by a heat sealing process, an ultrasonic welding process or the like.

Another object of this invention is to provide a method of securing a collapsible container to a mounting cup that eliminates exposure of a valve body to an aerosol propellant.

The foregoing has outlined some of the more pertinent objects of the present invention. These objects should be construed as being merely illustrative of some of the more prominent features and applications of the invention. Many other beneficial results can be obtained by applying the disclosed invention in a different manner within the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to an improved mounting cup for dispensing an aerosol product from a collapsible container within an aerosol container. The improved mounting cup comprises a peripheral rim located in proximity to an outer periphery of the mounting cup for sealing the mounting cup to the aerosol container. A turret is located in proximity to an inner periphery of the mounting cup for receiving an aerosol valve for dispensing the aerosol product from the collapsible container. A mounting surface is located intermediate the peripheral rim and the turret for securing the collapsible container to mounting cup. In one example, the collapsible container comprises a flexible bag for containing the aerosol product.

Preferably, the mounting surface is integral with the mounting cup. In one embodiment of the invention, the mounting surface extends generally parallel to an axis of symmetry of the mounting cup. In another embodiment of the invention, the mounting surface extends generally perpendicular to an axis of symmetry of the mounting cup. The mounting surface may comprise a cylindrical surface having a cylindrical axis coincident with an axis of symmetry of the mounting cup.

In one example of the invention, the mounting surface extends from the mounting cup into the aerosol container. In another example of the invention, a recess within the mounting cup defines the mounting surface.

In a more specific embodiment of the invention, a bond secures the collapsible container to mounting cup. In one embodiment of the invention, a polymeric bond material secures the collapsible container to mounting cup. The polymeric bond material may include a first polymeric bond material located on the mounting surface of the mounting cup and a second polymeric bond material located on the collapsible container. The first polymeric bond material bonds with the second polymeric bond material for securing the collapsible container to mounting cup.

The invention is also incorporated into an improved aerosol dispenser for dispensing an aerosol product under pressure from an aerosol propellant. The improved aerosol dispenser comprises an aerosol container for containing the aerosol propellant. An aerosol valve is mounted to a mounting cup. The mounting cup is sealed to the aerosol container. A collapsible container is secured to the mounting cup to extend within the aerosol container and for enabling the aerosol propellant to apply pressure to the collapsible container for dispensing the aerosol product through the aerosol valve.

The invention is also incorporated into the method of securing a collapsible container to a mounting cup comprising the steps of forming a mounting cup having a sealing surface located radially inwardly from an interior region of a peripheral rim of the mounting cup and radially outwardly from a turret of the mounting cup. The collapsible container is formed and is bonded to the sealing surface of the mounting cup.

In another example, invention is incorporated into the method of securing a collapsible container to a mounting cup. The method comprises the steps of forming a mounting cup to have a first polymeric sealing material thereon. A collapsible container is formed having a second polymeric sealing material thereon. The first polymeric sealing material is sealed to the second polymeric sealing material for securing the collapsible container to mounting cup.

In a more specific embodiment of the invention, the step of forming a mounting cup includes forming the mounting cup from a sheet of metallic material laminated with the first polymeric sealing material thereon. The step of forming the collapsible container includes forming the collapsible container from a metallic material laminated with the second polymeric sealing material thereon. In the alternative, the step of forming the collapsible container includes forming the collapsible container from a polymeric sealing material.

The invention is also incorporated into the method of filling a collapsible container with an aerosol product with the collapsible container being located within the aerosol container of an aerosol dispenser. The aerosol dispenser comprises an aerosol mounting cup secured to an aerosol container, the aerosol mounting cup having a turret for supporting an aerosol valve and with an aperture defined in the aerosol mounting cup. The method comprises the steps of forming a mounting cup having a sealing surface radially outward of the turret. The collapsible container is formed and is bonded to the sealing surface of the mounting cup. The aerosol product is injected under pressure into the aperture defined in the aerosol mounting cup for filling the collapsible container.

In one example of the invention, the step of bonding the first polymeric sealing material to the second polymeric sealing material includes heat sealing the first polymeric sealing material to the second polymeric sealing material. In another example of the invention, the step of bonding the first polymeric sealing material to the second polymeric sealing material includes sonically welding the first polymeric sealing material to the second polymeric sealing material.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
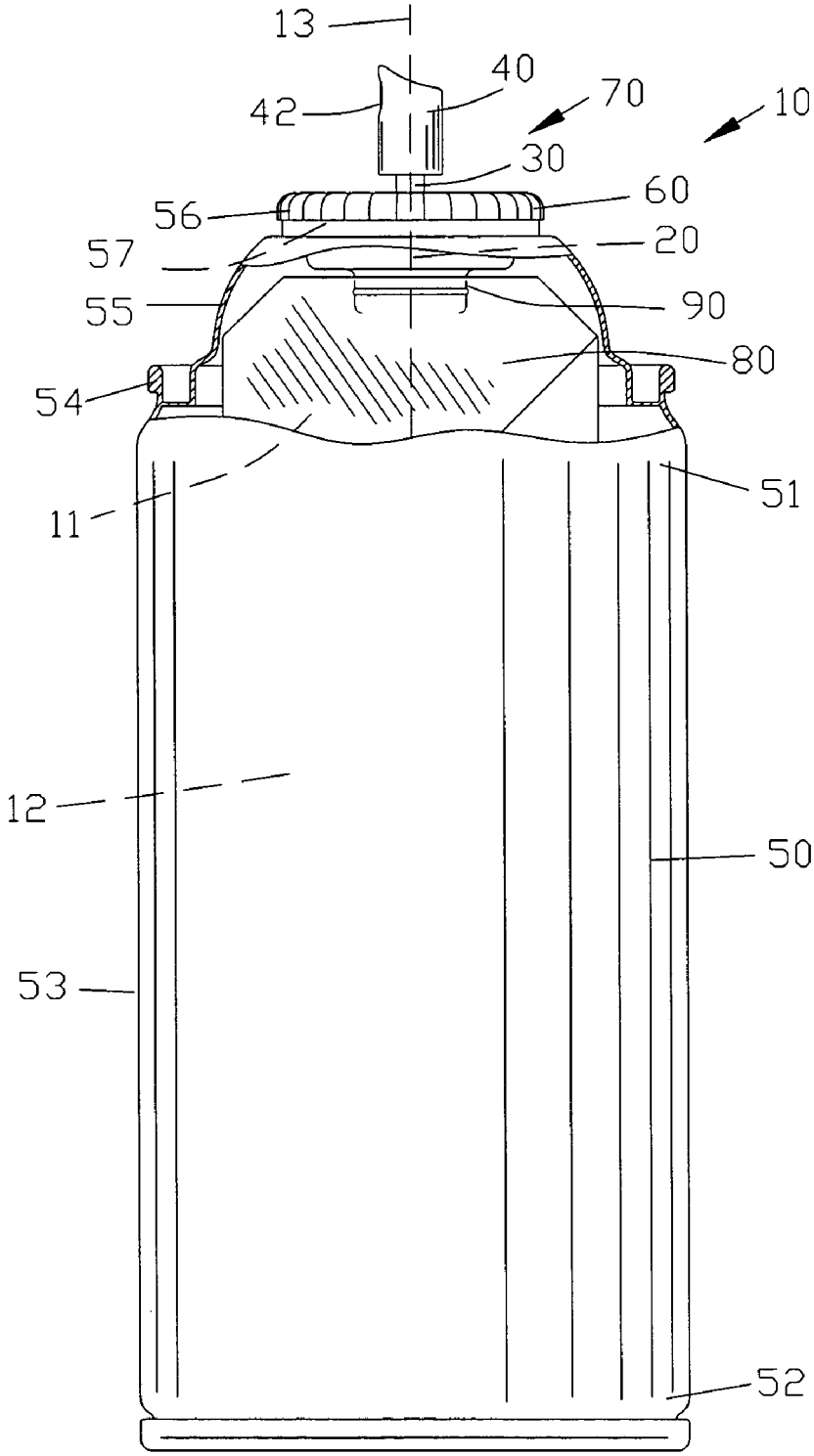
FIG. 1 is a partial cut away side view of an aerosol dispenser incorporating the improved mounting cup of the present invention for dispensing an aerosol product from a collapsible container.

FIG. 1 is a side view partially in section of an improved aerosol dispenser 10 for dispensing an aerosol product 11 with an aerosol propellant 12. The improved aerosol dispenser 10 defines an axis of symmetry 13. An aerosol valve 20 controls the flow of the aerosol product 11 through a valve stem 30 into a valve actuator 40 for discharge from a terminal orifice 42. The aerosol product 11 and the aerosol propellant 12 are stored within an aerosol container 50. The aerosol propellant 12 may be any of the propellants used for aerosol dispensers including liquefied propellants such as hydrocarbons and hydrofluorocarbons and any of the compressed gases such as carbon dioxide or nitrogen.

The aerosol container 50 is shown as a cylindrical container of conventional design and material. The aerosol container 50 extends between a top portion 51 and a bottom portion 52. The aerosol container 50 defines a cylindrical sidewall 53 defining a container rim 54 extending about an outer diameter of the aerosol container 50. The top portion 51 of the aerosol container 50 tapers radially inwardly into a neck 55 terminating in a bead 56. The bead 56 defines an opening 57 in the aerosol container 50 for receiving a mounting cup 60. As will be described in greater detail hereinafter, plural gaskets 70 provide a seal for sealing the mounting cup 60 to the aerosol container 50 and for providing a seal for sealing the aerosol valve 20 the mounting cup 60.

A collapsible container 80 is located within the aerosol container 50. The collapsible container 80 is secured to the mounting cup 60 by a container connector 90. The collapsible container 80 is selected to contain the aerosol product 11.

Figure 2:
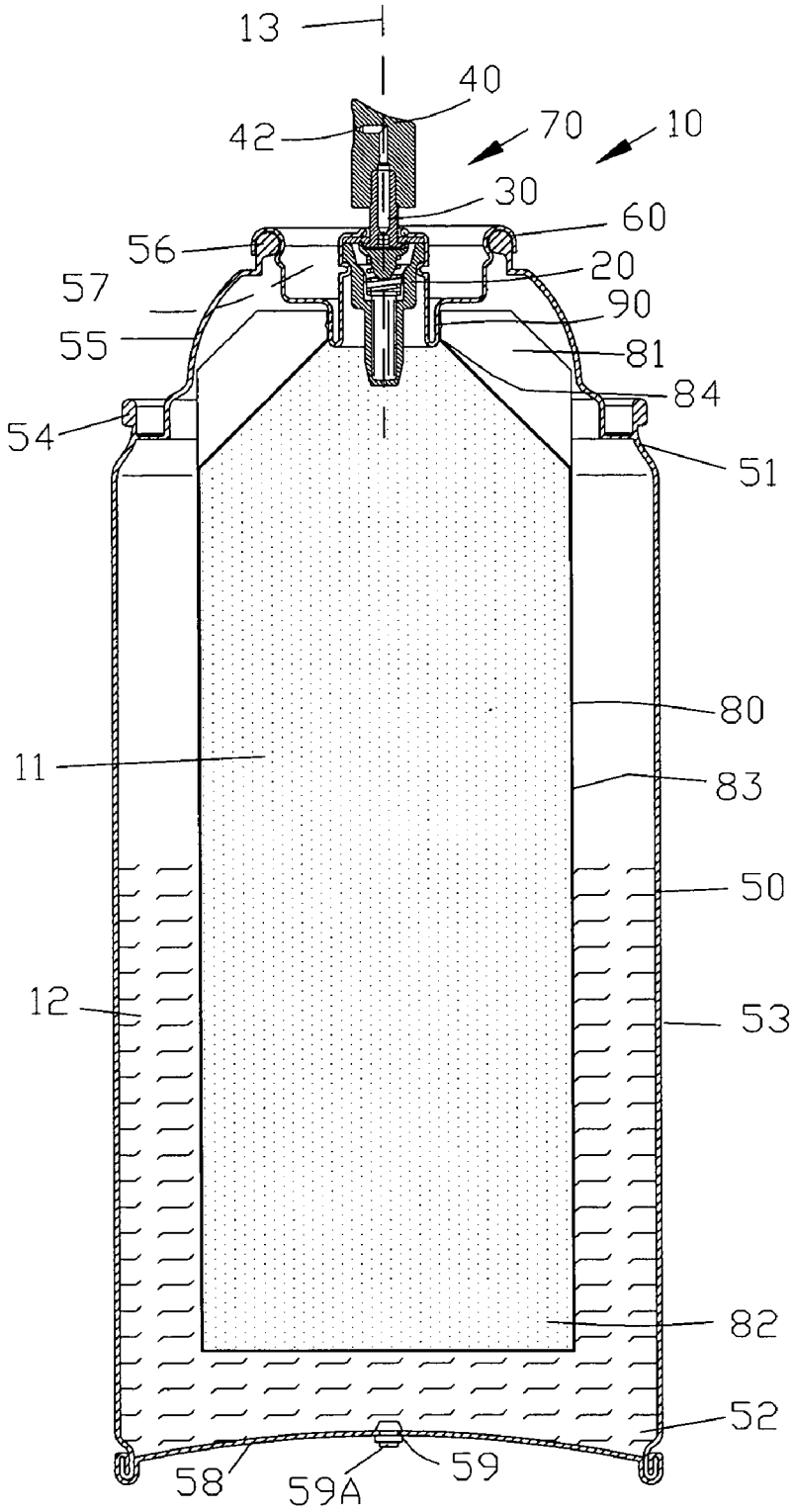
FIG. 2 is a side sectional view of the aerosol dispenser of FIG. 1.

FIG. 2 is a side sectional view of the aerosol dispenser of FIG. 1. The bottom portion 52 of the aerosol container 50 is closed by an endwall 58 having a filling aperture 59 closed by a plug 59A. The filling aperture 59 is separate and distinct from the opening 57 in the aerosol container 50 for the mounting cup 60. The filling aperture 59 enables the aerosol propellant 12 to be introduced into the aerosol container 50 and to be sealed by the plug 59A after filling with the aerosol propellant 12. In the alternative, the plug 59A may be a one-way filling valve for filling the aerosol container 50 with the aerosol propellant 12. The one-way filling valve 59A may be a one-way filling valve commonly referred to as an umbrella valve. Preferably, aerosol container 50 is filled by conventional filling machine well known in the art.

In the alternative, the aerosol container 50 may be filled with the aerosol propellant 12 through an under the cup filling process. In the under the cup filling process, the aerosol propellant 12 is injected into the aerosol container 50 between the bead 56 of the aerosol container 50 and the mounting cup 60 prior to complete insertion of the mounting cup 60 into the opening 57 of the aerosol container 50. The under the cup filling process eliminates the need for the filling aperture 59 and the plug 59A in the aerosol container 50. In a further alternative, a single aerosol propellant 12 or plural the aerosol propellants may be injected into the aerosol container 50 by both the filling aperture 59 as well as the under the cup filling process.

The collapsible container 80 containing the aerosol product 11 is located within the aerosol container 50. The collapsible container 80 extends between a top portion 81 and a bottom portion 82 and defines a sidewall 83 therebetween. The top portion 81 of the collapsible container 80 defines a collapsible container opening 84 whereas the bottom portion 82 of the collapsible container 80 is closed to provide a fluid tight seal. The collapsible container 80 is formed from a flexible material for enabling an external pressure from the aerosol propellant 12 to propel the aerosol product 11 from the collapsible container 80. The collapsible container 80 is secured to the mounting cup 60 by the container connector 90 in a manner that will be described in greater detail hereinafter.

Figure 3:
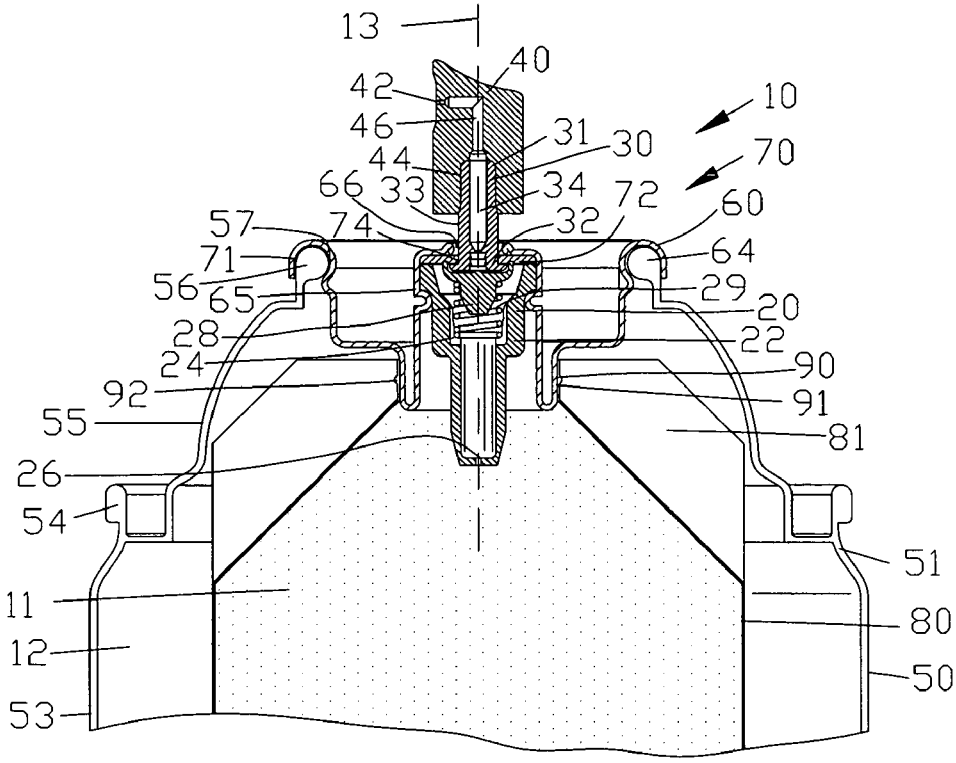
FIG. 3 is an enlarged view of a portion of FIG. 2 in a non-operating condition.

FIG. 3 is an enlarged view of a portion of FIG. 2 in a non-operating condition. The mounting cup 60 has a peripheral rim 64 for sealing to the bead 56 of the aerosol container 50. The gasket 70 includes a rim gasket 71 located between the peripheral rim 64 of the mounting cup 60 and the bead 56 of the aerosol container 50. The peripheral rim 64 of the mounting cup 60 is crimped to the bead 56 of the aerosol container 50 in a conventional fashion for sealably securing the mounting cup 60 to the aerosol container 50. The mounting cup 60 includes a turret 65 for receiving the aerosol valve 20. The turret 65 of the mounting cup 60 defines a central aperture 66.

The aerosol valve 20 includes a valve body 22 secured to the turret 65 of the mounting cup 60. The turret 65 is crimped to contain the valve body 22 within the mounting cup 60 in a conventional fashion. A valve gasket 72 of the gasket 70 provides a fluid tight seal between the 15 valve body 22 and the turret 65 of the mounting cup 60. The valve gasket 72 includes a central aperture 74 for enabling the valve stem 30 to pass through the valve gasket 72 and extend beyond the central aperture 66 of the turret 65.

The aerosol valve 20 includes a valve body 22 defining an internal valve cavity 24. The internal valve cavity 24 is connected by a channel 26 to the collapsible container 80 for providing fluid communication between the collapsible container 80 and the internal valve cavity 24 of the valve body 22. The aerosol valve 20 includes a valve element 28 positioned within the internal valve cavity 24. A bias spring 29 is located between the valve body 22 and the valve element 28. The bias spring 29 biases the valve element 28 into a closed position shown in FIG. 3 to inhibit the flow of the aerosol product 11 through the stem passageway 34 of the valve stem 30. Preferably, the valve body 22 is formed from a polymeric material.

The valve stem 30 extends between a first end 31 and a second end 32. The valve stem 30 defines an outer surface 33 with a stem passageway 34 extending therein. The stem passageway 34 provides fluid communication between the aerosol valve 20 and the terminal orifice 42 of the valve actuator 40.

The valve actuator 40 includes a socket 44 for frictionally receiving the first end 31 of the valve stem 30. The actuator 40 includes an actuator passage 46 interconnecting the socket 44 to the terminal orifice 42. The socket 44 of the valve actuator 40 is frictionally secured to the valve stem 30. The valve stem 30 extends through the central aperture 66 of the turret 65 of the mounting cup 60 for interconnecting the valve actuator 40 and the valve element 28 for enabling the actuator 40 to open the aerosol valve 20. The valve actuator 40 may be covered by a protective overcap or cover (not shown) for preventing accidental actuation of the aerosol valve 20 during shipping and/or to prevent accidental actuation by a consumer.

The collapsible container 80 is shown as a flexible collapsible container 80 for enabling the aerosol propellant 12 located within the aerosol container 50 to apply a pressure to the collapsible container 80. In one example of the invention, the collapsible container 80 is formed from a sheet of laminated aluminum foil. The sheet of laminated aluminum foil is folded with the bottom portion 82 and the sidewall 83 being joined to form a pouch. The laminated aluminum foil may include various layers of differing materials such as nylon, aluminum and polypropylene, or nylon, aluminum and polyethylene and the like.

The container connector 90 comprises a sealing surface 91 defined by the mounting cup 90 and a bond 92 for affixing the collapsible container 80 to the sealing surface 91. The sealing surface 91 may be defined by various surfaces on the mounting cup 60. The bond 92 may comprise various types methods of affixing the collapsible container 80 to the sealing surface 91 including sonic welding, adhesives, radio frequency welding, laser welding, mechanical fasteners such as mechanical clamps, friction or by any other suitable means.

Figure 4:
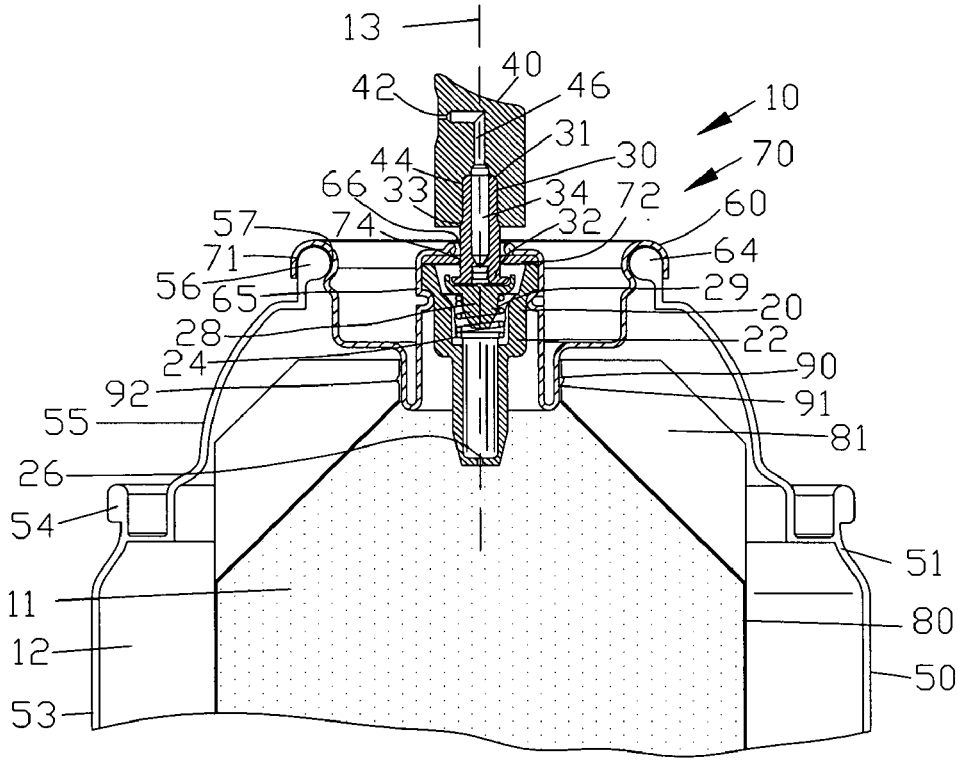
FIG. 4 is an enlarged view of a portion of FIG. 2 in an operating condition.

FIG. 4 illustrates the improved aerosol dispenser 10 in an actuated position for discharging the aerosol product 11. When the actuator 40 is moved into the actuated position, the valve element 28 is displaced for enabling the flow of the aerosol product 11 to pass through the aerosol valve 20. The aerosol propellant 12 located within the aerosol container 50 applies a pressure to the collapsible container 80 to discharge the aerosol product 11. The aerosol product 11 is expelled from the terminal orifice 42 without the expulsion of the propellant 12. The collapsible container 80 collapses as the aerosol product 11 is depleted therefrom.

Figure 5:
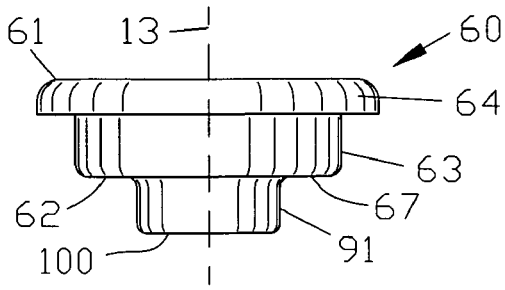
FIG. 5 is an enlarged side view of a first embodiment of the improved mounting cup of the present invention.
Figure 6:
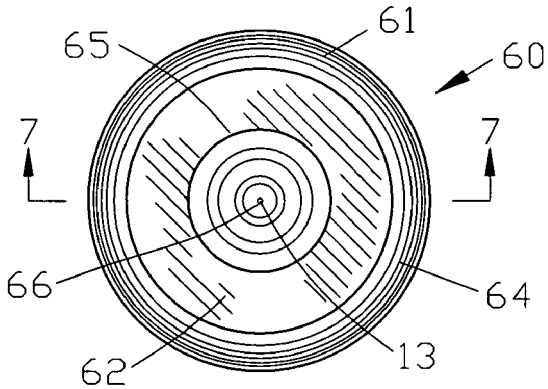
FIG. 6 is a top view of FIG. 5.
Figure 7:
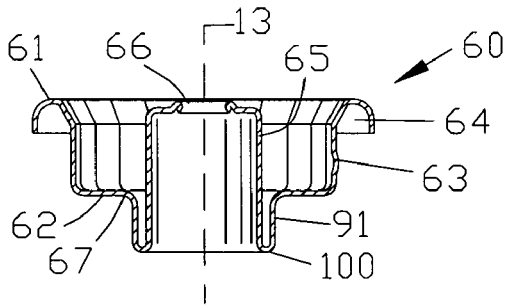
FIG. 7 PRIOR ART
FIG. 7 is a sectional view along line 7-7 in FIG. 6.

FIGS. 5-7 illustrate enlarged views of a first embodiment of an improved mounting cup 60 of the present invention shown in FIGS. 1-4. The mounting cup 60 extends between a first end 61 and a second end 62. A sidewall 63 interconnects the first end 61 with a second end 62. The sidewall 63 is substantially coaxial with the axis of symmetry 13 extending through the improved aerosol device 10. A cross-section of the sidewall 63 is substantially parallel to the axis of symmetry 13 at shown in FIG. 7.

The second end 62 of the improved mounting cup 60 defines a bottom wall 67. The bottom wall 67 is substantially perpendicular to the axis of symmetry 13 extending through the improved aerosol device 10. A cross-section of the bottom wall 67 being substantially perpendicular to the axis of symmetry 13 is shown in FIG. 7.

The improved mounting cup 60 of the present invention includes the sealing surface 91 located radially between the sidewall 63 and the turret 65 of the mounting cup 60. The sealing surface 91 is integrally formed with the improved mounting cup 60 as a one-piece unit.

The sealing surface 91 of the first embodiment of the improved mounting cup 60 is incorporated into a projection 100 extending from the second end 62 of the improved mounting cup 60. The projection 100 extends from the bottom wall 67 of the improved mounting cup 60 to define the sealing surface 91.

The sealing surface 91 defines a cylindrical surface substantially coaxial with the axis of symmetry 13 extending through the improved aerosol device 10. The cylindrical axis of the cylindrical sealing surface 91 is coincident with axis of symmetry 13 extending through the improved aerosol device 10. A cross-section of the sealing surface 91 is substantially parallel to the axis of symmetry 13 is shown in FIG. 7.

Figure 7A:
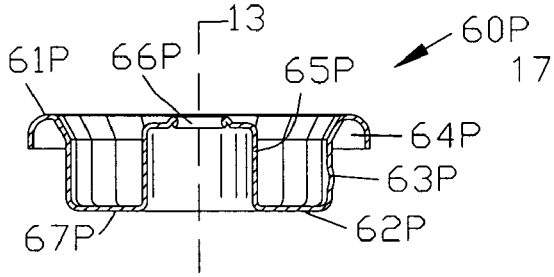
FIG. 7A is a sectional view similar to FIG. 7 of a mounting cup of the prior art.

FIG. 7A illustrates a mounting cup 60P of the prior art. The mounting cup 60P extends between a first end 61P and a second end 62P. A sidewall 63P interconnects the first end 61P with a second end 62P. The second end 62P of the mounting cup 60P defines a bottom wall 67P. The sidewall 63P is substantially coaxial with the axis of symmetry 13 whereas the bottom wall 67P is substantially perpendicular to the axis of symmetry 13.

In contrast to the mounting cup 60P of the prior art, the improved mounting cup 60 of the present invention provides the projection 100 extending from the bottom wall 67 of the improved mounting cup 60 to define a cylindrical surface 91 substantially coaxial with the axis of symmetry 13 extending through the improved aerosol device 10. The cylindrical surface 91 is located between the turret 65 and the sidewall 63 of the improved mounting cup 60. The cylindrical surface 91 provides a surface for attaching the collapsible container 80 directly to the improved mounting cup 60. Although the projection 100 has been shown located immediately adjacent to the turret 65, it should be understood the projection 100 may be place at other locations between the turret 65 and the sidewall 63.

Figure 8:
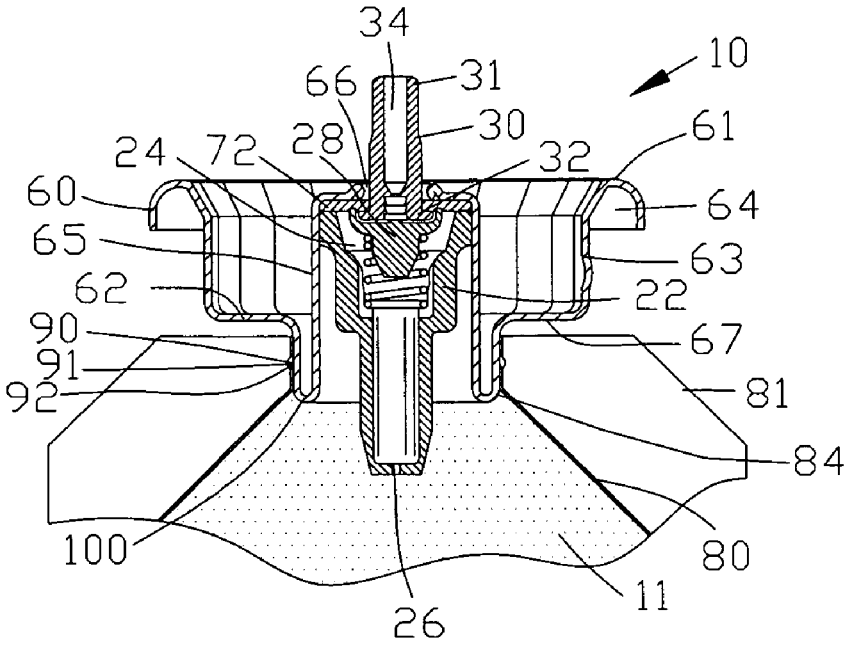
FIG. 8 is a sectional view of the improved mounting cup of FIGS. 5-7 secured to the collapsible container.

FIG. 8 is a sectional view of the improved mounting cup 60 of FIGS. 5-7 secured to the collapsible container 80. The top portion 81 of the collapsible container 80 is sealed to form a container opening 84 suitable for securing to the cylindrical surface 91. A bond 92 affixes the container opening 84 of the collapsible container 80 to the cylindrical surface 91 of the mounting cup 60.

Figure 9:
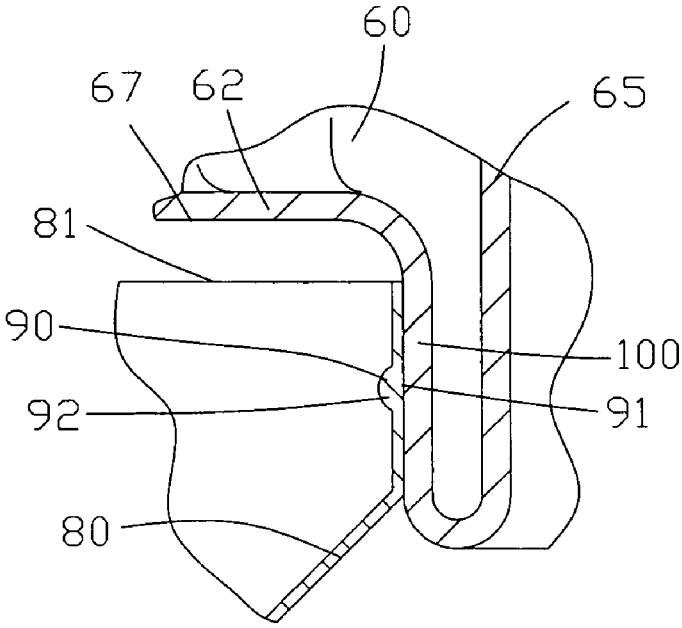
FIG. 9 is an enlarged view of a portion of FIG. 8.

FIG. 9 is an enlarged view of a portion of FIG. 8 further illustrating the bond 92 between the improved mounting cup 60 and the collapsible container 80. In this example, the collapsible container 80 is shown as a metallic collapsible container 80 secured directly to a metallic mounting cup 60 by the bond 92. The bond 92 may comprise a weld, a radio frequency weld, laser weld, an adhesive, a mechanical fastener such as mechanical clamps, friction or by any other suitable means.

Figure 10:
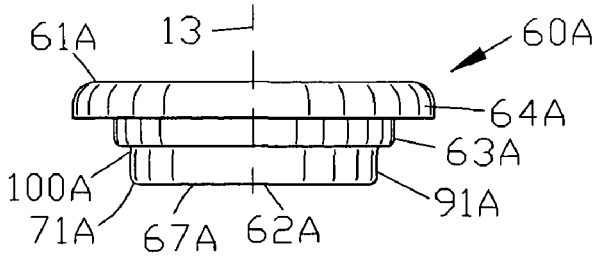
FIG. 10 is an enlarged side view of a second embodiment of the improved mounting cup of the present invention.
Figure 11:
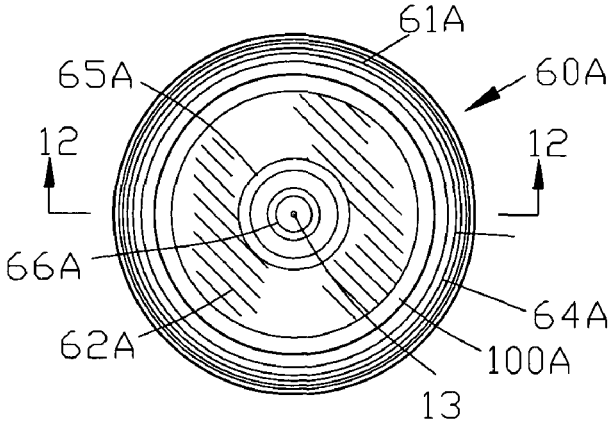
FIG. 11 is a top view of FIG. 10.
Figure 12:
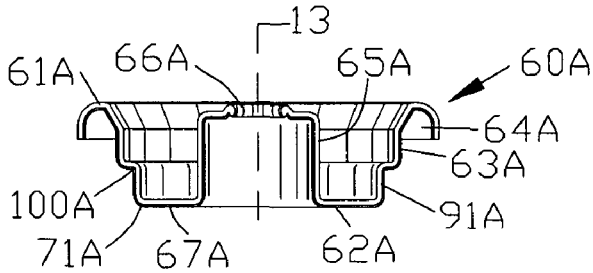
FIG. 12 is a sectional view along line 12-12 in FIG. 11.

FIGS. 10-12 illustrate enlarged views of a second embodiment of an improved mounting cup 60A of the present invention shown in FIGS. 1-4. The mounting cup 60A extends between a first end 61A and a second end 62A. A sidewall 63A interconnects the first end 61A with a second end 62A. The sidewall 63A is substantially coaxial with the axis of symmetry 13 extending through the improved aerosol device 10. A cross-section of the sidewall 63A is substantially parallel to the axis of symmetry 13 at shown in FIG. 12.

The second end 62A of the improved mounting cup 60A defines a bottom wall 67A. The bottom wall 67A is substantially perpendicular to the axis of symmetry 13 extending through the improved aerosol device 10. A cross-section of the bottom wall 67A being substantially perpendicular to the axis of symmetry 13 is shown in FIG. 12.

The second embodiment of the improved mounting cup 60A includes a gasket material 71A affixed to the improved mounting cup 60A. The gasket material 71A provides a seal for sealing the peripheral rim 64A of the improved mounting cup 60A to the bead 56 of the aerosol container 50. The gasket material 71A covers the entire underside of the improved mounting cup 60A. The gasket material 71A may be a polymeric material laminated to sheet stock prior to the formation of the mounting cup 60A.

The sealing surface 91A of the second embodiment of the improved mounting cup 60A is incorporated into a recess 100A defined within the sidewall 63A of the improved mounting cup 60A. The recess 100A is shown as a cylindrical recess 100A defining a generally cylindrical sealing surface 91A substantially coaxial with the axis of symmetry 13 extending through the improved aerosol device 10. The cylindrical axis of the cylindrical sealing surface 91A is coincident with axis of symmetry 13 extending through the improved aerosol device 10. A cross-section of the sealing surface 91A is substantially parallel to the axis of symmetry 13 is shown in FIG. 12.

Figure 12A:
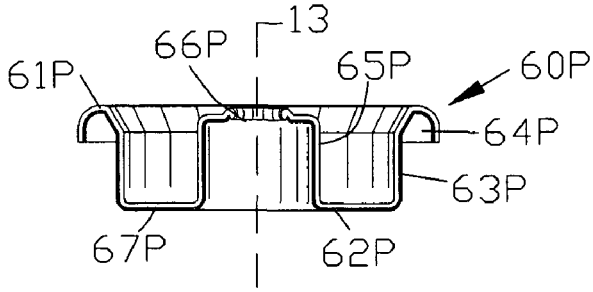
FIG. 12A is a sectional view similar to FIG. 12 of a mounting cup of the prior art.

FIG. 12A illustrates a mounting cup 60P of the prior art. The mounting cup 60P extends between a first end 61P and a second end 62P. A sidewall 63P interconnects the first end 61P with a second end 62P. The second end 62P of the mounting cup 60P defines a bottom wall 67P. The sidewall 63P is substantially coaxial with the axis of symmetry 13 whereas the bottom wall 67P is substantially perpendicular to the axis of symmetry 13.

In contrast to the mounting cup 60P of the prior art, the improved mounting cup 60A of the present invention provides the recess 100A located within the sidewall 63A of the improved mounting cup 60A to define a cylindrical surface 91A substantially coaxial with the axis of symmetry 13 extending through the improved aerosol device 10. The cylindrical surface 91A is located between the turret 65A and the sidewall 63A of the improved mounting cup 60A. The cylindrical surface 91A provides a surface for attaching the collapsible container 80 to the improved mounting cup 60A.

Figure 13:
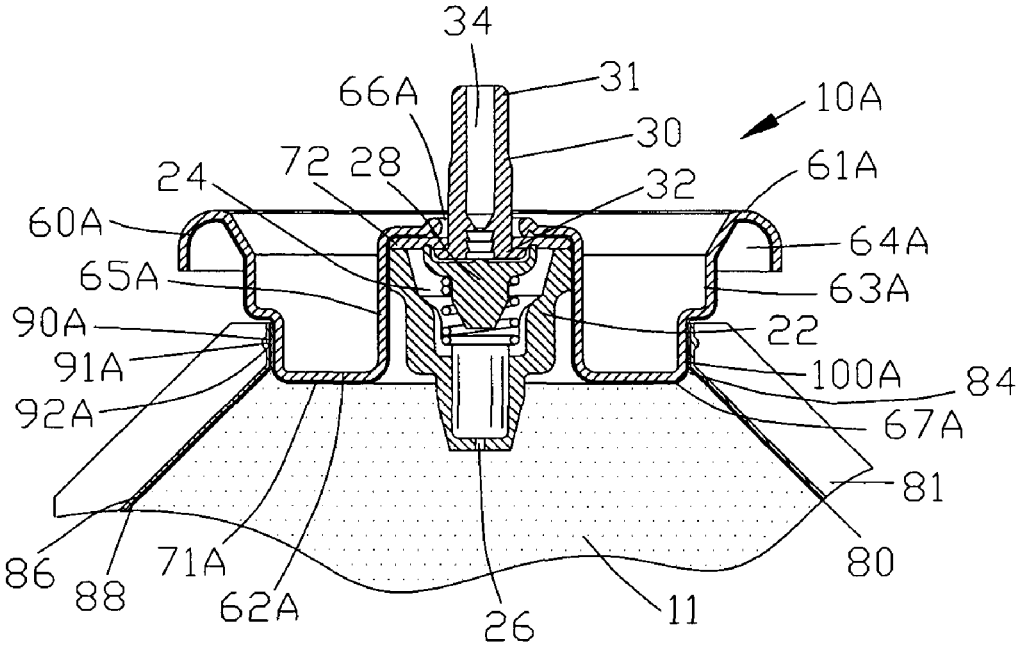
FIG. 13 is a sectional view of the improved mounting cup of FIGS. 10-12 secured to the collapsible container.

FIG. 13 is a sectional view of the improved mounting cup 60A of FIGS. 10-12 secured to the collapsible container 80. The top portion 81 of the collapsible container 80 is sealed to form a container opening 84 suitable for securing to the cylindrical surface 91A. A bond 92A affixes the container opening 84 of the collapsible container 80 to the cylindrical surface 91A of the mounting cup 60A.

Figure 14:
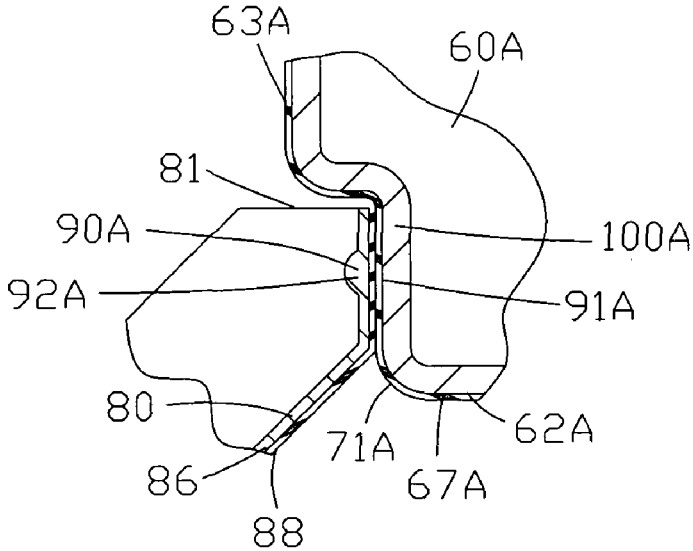
FIG. 14 is an enlarged view of a portion of FIG. 13.

FIG. 14 is an enlarged view of a portion of FIG. 13 further illustrating the bond 92A between the improved mounting cup 60A and the collapsible container 80. In this example, the collapsible container 80 is shown as a metallic sheet 86 and a polymeric sheet 88 laminated to form a unitary sheet for forming the collapsible container 80. The bond 92A comprises the polymeric sheet 88 of the collapsible container 80 sealing to the gasket material 71A covering the entire underside of the improved mounting cup 60A. Preferably, the melting temperature of the polymeric sheet 88 of the collapsible container 80 is very similar to the melting temperature of the gasket material 71A of the improved mounting cup 60A. The bond 92A may be formed by conventional heating, sonic heating, radio frequency heating, laser heating or by any other suitable means. Although the bond 92A has been shown as a seal formed between the polymeric sheet 88 of the collapsible container 80 and the gasket material 71A of the improved mounting cup 60A, it should be understood that the bond 92A may be formed with only the polymeric sheet 88 of the collapsible container 80 or may be formed with only the gasket material 71A of the improved mounting cup 60A.

Figure 15:
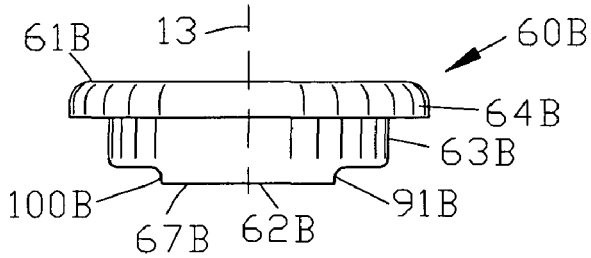
FIG. 15 is an enlarged side view of a third embodiment of the improved mounting cup of the present invention.
Figure 16:
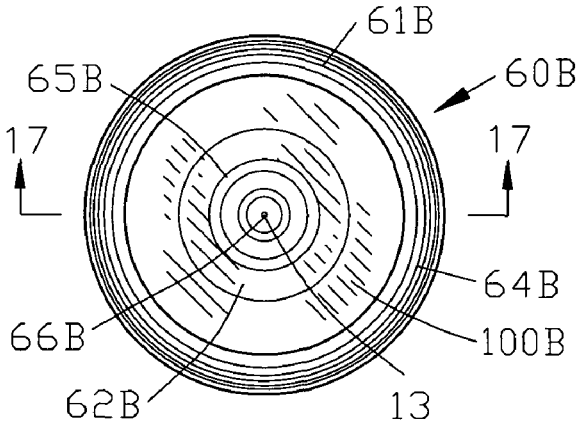
FIG. 16 is a top view of FIG. 15.
Figure 17:
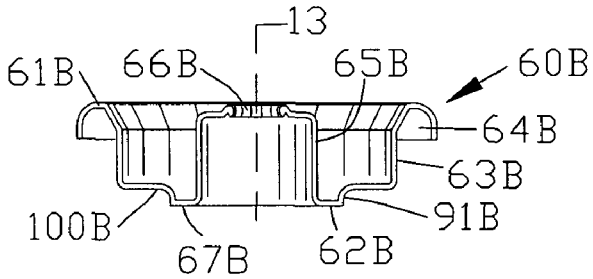
FIG. 17 is a sectional view along line 17-17 in FIG. 16.

FIGS. 15-17 illustrate enlarged views of a third embodiment of an improved mounting cup 60B of the present invention shown in FIGS. 1-4. The mounting cup 60B extends between a first end 61B and a second end 62B interconnected by a sidewall 63B. The sidewall 63B is substantially coaxial with the axis of symmetry 13 with a cross-section of the sidewall 63B being substantially parallel to the axis of symmetry 13 at shown in FIG. 17.

The second end 62B of the improved mounting cup 60B defines a bottom wall 67B. The bottom wall 67B is substantially perpendicular to the axis of symmetry 13 with a cross-section of the bottom wall 67B being substantially perpendicular to the axis of symmetry 13 as shown in FIG. 17.

The sealing surface 91B of the third embodiment of the improved mounting cup 60B is incorporated into a recess 100B defined within the bottom wall 67B of the improved mounting cup 60B. The recess 100B is shown as a cylindrical recess 100B defining a generally cylindrical sealing surface 91B substantially coaxial with the axis of symmetry 13. The cylindrical axis of the cylindrical sealing surface 91B is coincident with axis of symmetry 13 with a cross-section of the sealing surface 91B being substantially parallel to the axis of symmetry 13 as shown in FIG. 17.

Figure 17A:
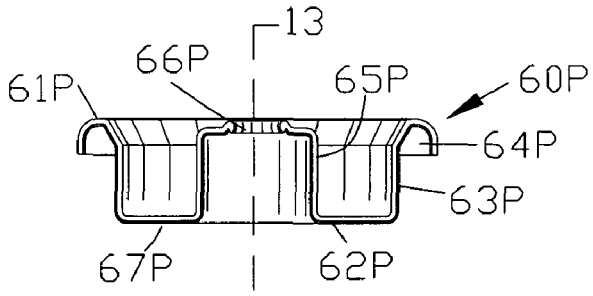
FIG. 17A is a sectional view similar to FIG. 17 of a mounting cup of the prior art.

FIG. 17A illustrates a mounting cup 60P of the prior art. The mounting cup 60P extends between a first end 61P and a second end 62P. A sidewall 63P interconnects the first end 61P with a second end 62P. The second end 62P of the mounting cup 60P defines a bottom wall 67P. The sidewall 63P is substantially coaxial with the axis of symmetry 13 whereas the bottom wall 67P is substantially perpendicular to the axis of symmetry 13.

In contrast to the mounting cup 60P of the prior art, the improved mounting cup 60B of the present invention provides the recess 100B located within the bottom wall 67B of the improved mounting cup 60B to define a cylindrical surface 91B substantially coaxial with the axis of symmetry 13. The cylindrical surface 91B is located between the turret 65B and the sidewall 63B of the improved mounting cup 60B. The cylindrical surface 91B provides a surface for attaching the collapsible container 80 to the improved mounting cup 60B.

Figure 18:
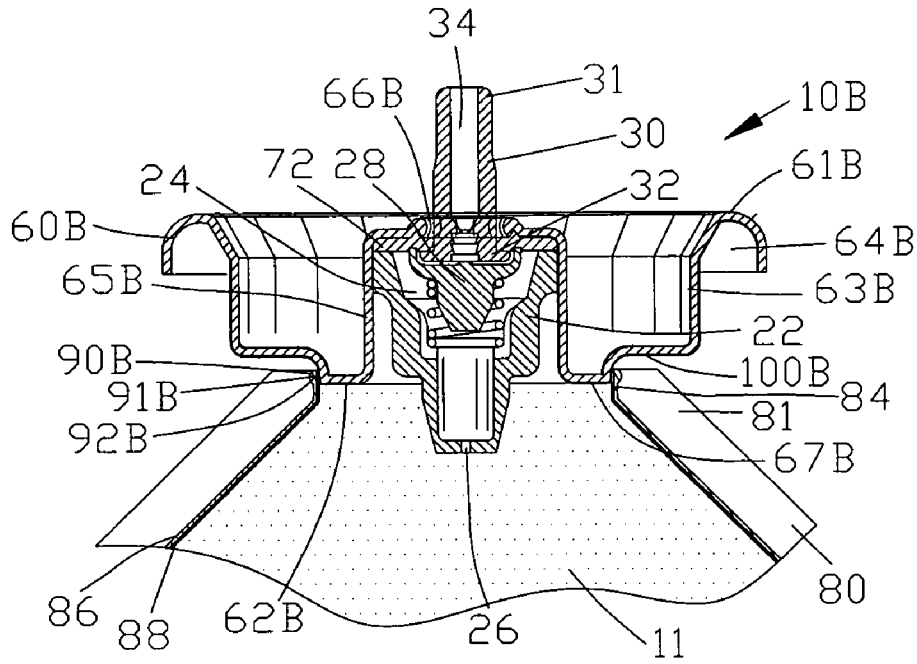
FIG. 18 is a sectional view of the improved mounting cup of FIGS. 15-17 secured to the collapsible container.

FIG. 18 is a sectional view of the improved mounting cup 60B of FIGS. 15-17 secured to the collapsible container 80. The top portion 81 of the collapsible container 80 is sealed to form a container opening 84 suitable for securing to the cylindrical surface 91B. A bond 92B affixes the container opening 84 of the collapsible container 80 to the cylindrical surface 91B of the mounting cup 60B.

Figure 19:
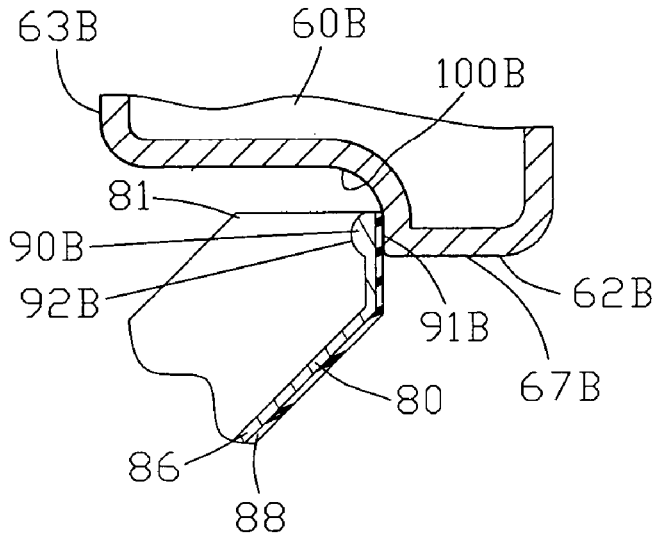
FIG. 19 is an enlarged view of a portion of FIG. 18.

FIG. 19 is an enlarged view of a portion of FIG. 18 further illustrating the bond 92B between the improved mounting cup 60B and the collapsible container 80. In this example, the collapsible container 80 is shown as a metallic sheet 86 and a polymeric sheet 88 laminated to form a unitary sheet for forming the collapsible container 80. The bond 92B comprises the polymeric sheet 88 of the collapsible container 80 sealing to the improved mounting cup 60B. Typically, the improved mounting cup 60B is formed from a metallic material. The bond 92B may be formed by conventional heating, sonic heating, radio frequency heating, laser heating or by any other suitable means. Although the bond 92B has been shown as a seal formed between the polymeric sheet 88 of the collapsible container 80 and the improved mounting cup 60B, it should be understood that the bond 92B or may be formed with only the gasket material on the improved mounting cup 60B.

Figure 20:
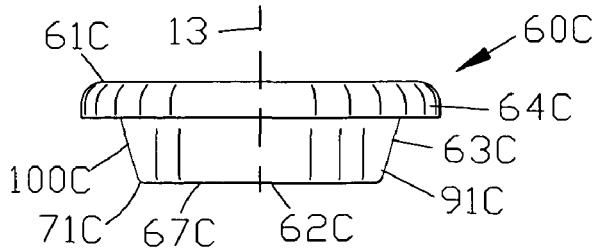
FIG. 20 is an enlarged side view of a fourth embodiment of the improved mounting cup of the present invention.
Figure 21:
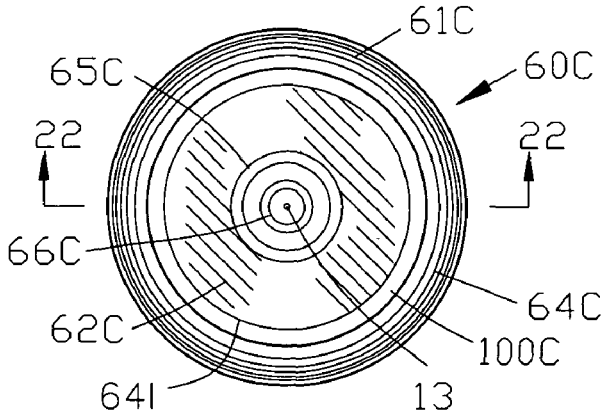
FIG. 21 is a top view of FIG. 20.
Figure 22:
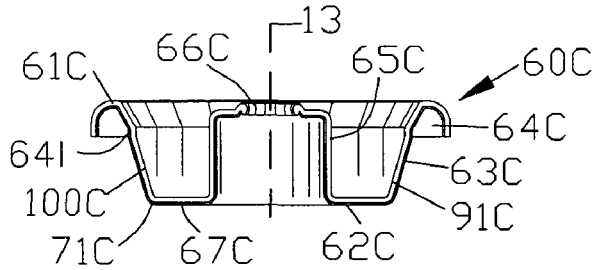
FIG. 22 is a sectional view along line 22-22 in FIG. 21.

FIGS. 20-22 illustrate enlarged views of a fourth embodiment of an improved mounting cup 60C of the present invention shown in FIGS. 1-4. The mounting cup 60C extends between a first end 61C and a second end 62C interconnected by a sidewall 63C. The sidewall 63C is substantially coaxial with the axis of symmetry 13 with a cross-section of the sidewall 63C being disposed angularly relative to the axis of symmetry 13 at shown in FIG. 22. The angularly disposed sidewall 63C extends radially inwardly from an interior region 64I of the peripheral rim 64C of the improved mounting cup 60C toward the axis of symmetry 13 of the improved mounting cup 60C.

The second end 62C of the improved mounting cup 60C defines a bottom wall 67C. The bottom wall 67C is substantially perpendicular to the axis of symmetry 13 with a cross-section of the bottom wall 67C being substantially perpendicular to the axis of symmetry 13 as shown in FIG. 22.

The fourth embodiment of the improved mounting cup 60C includes a gasket material 71C affixed to the improved mounting cup 60C. The gasket material 71C provides a seal for sealing the peripheral rim 64C of the improved mounting cup 60C to the bead 56 of the aerosol container 50. The gasket material 71C may be a polymeric material laminated to sheet stock prior to the formation of the mounting cup 60A.

The sealing surface 91C of the fourth embodiment of the improved mounting cup 60C is incorporated into the angularly disposed sidewall 63C of the improved mounting cup 60C. The sealing surface 91C is shown as a generally circular ring on the angularly disposed sidewall 63C of the improved mounting cup 60C. The generally circular ring on the sidewall 63C is located radially inwardly from the interior region 64I of the peripheral rim 64C.

Figure 22A:
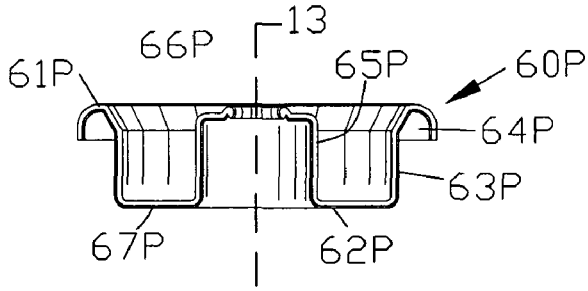
FIG. 22A is a sectional view similar to FIG. 22 of a mounting cup of the prior art.

FIG. 22A illustrates a mounting cup 60P of the prior art. The mounting cup 60P extends between a first end 61P and a second end 62P. A sidewall 63P interconnects the first end 61P with a second end 62P. The second end 62P of the mounting cup 60P defines a bottom wall 67P. The sidewall 63P is substantially coaxial with the axis of symmetry 13 whereas the bottom wall 67P is substantially perpendicular to the axis of symmetry 13.

In contrast to the mounting cup 60P of the prior art, the improved mounting cup 60C of the present invention provides a sealing surface 91C on the angularly disposed sidewall 63C of the improved mounting cup 60C to define a circular sealing surface 91C substantially coaxial with the axis of symmetry 13. The circular surface 91C is located between the turret 65C and the interior region 64I of the peripheral rim 64C of the improved mounting cup 60C. The circular sealing surface 91C provides a surface for attaching the collapsible container 80 to the improved mounting cup 60C.

Figure 23:
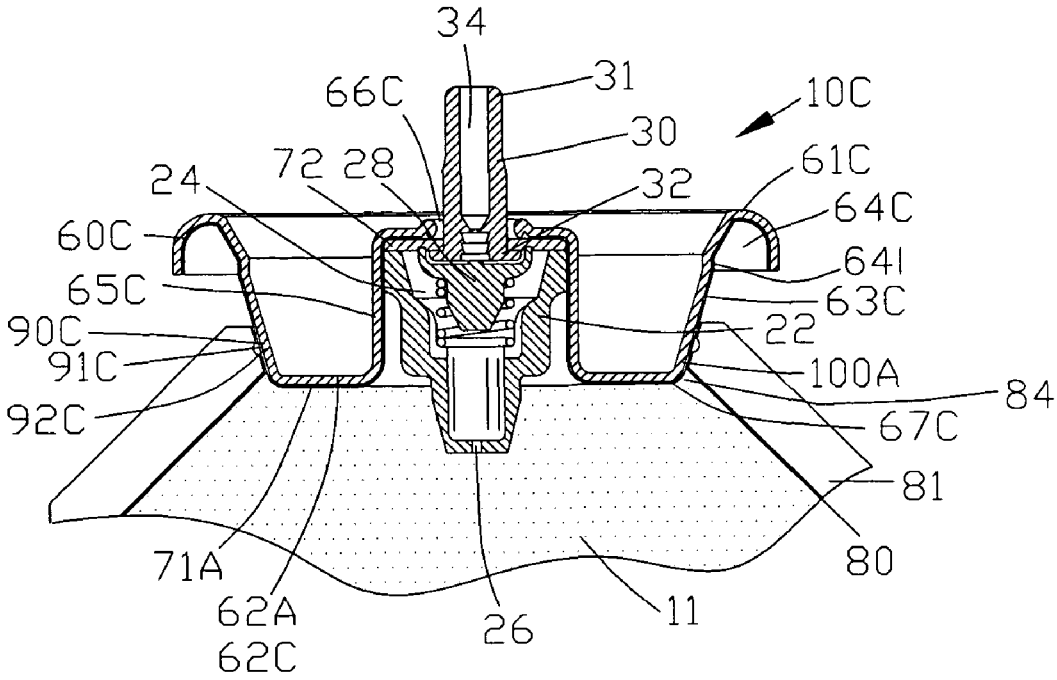
FIG. 23 is a sectional view of the improved mounting cup of FIGS. 20-22 secured to the collapsible container.

FIG. 23 is a sectional view of the improved mounting cup 60C of FIGS. 20-22 secured to the collapsible container 80. The top portion 81 of the collapsible container 80 is sealed to form a container opening 84 suitable for securing to the circular ring 91C. A bond 92C affixes the container opening 84 of the collapsible container 80 to the circular ring 91C of the mounting cup 60C. The generally circular ring on the sidewall 63C is located radially inwardly from the interior region 64I of the peripheral rim 64C a distance sufficient to provide clearance for inserting the improved mounting cup 60C and the attached collapsible container 80 through the opening 57 defined by the bead 56 of the aerosol container 50.

Figure 24:
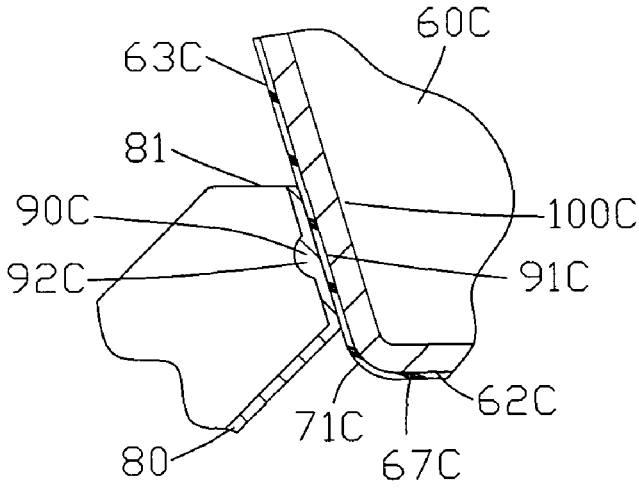
FIG. 24 is an enlarged view of a portion of FIG. 23.

FIG. 24 is an enlarged view of a portion of FIG. 23 further illustrating the bond 92C between the improved mounting cup 60C and the collapsible container 80. In this example, the collapsible container 80 is shown as a metallic collapsible container 80 secured directly to a metallic mounting cup 60C by the bond 92C. The bond 92C may comprise a weld, a radio frequency weld, laser weld, an adhesive, a mechanical fastener such as mechanical clamps, friction or by any other suitable means. In the alternative, the bond 92C may comprise any of the bonds previously set forth herein or any other suitable bond.

In this example, the collapsible container 80 is shown as a metallic sheet 80 forming the collapsible container 80. The bond 92C comprises the metallic sheet 80 of the collapsible container 80 sealing to the gasket material 71C covering the entire underside of the improved mounting cup 60C. The bond 92C may be formed by conventional heating, sonic heating, radio frequency heating, laser heating or by any other suitable means.

Figure 25:
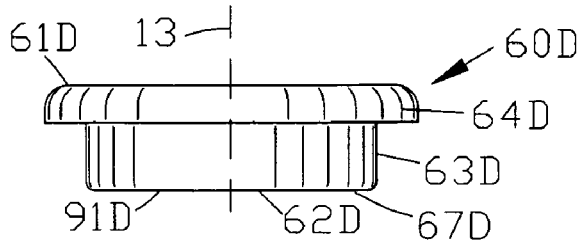
FIG. 25 is an enlarged side view of a fifth embodiment of the improved mounting cup of the present invention.
Figure 26:
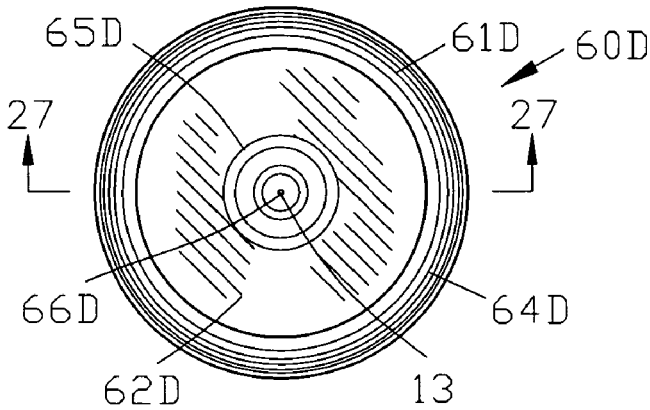
FIG. 26 is a top view of FIG. 25.
Figure 27:
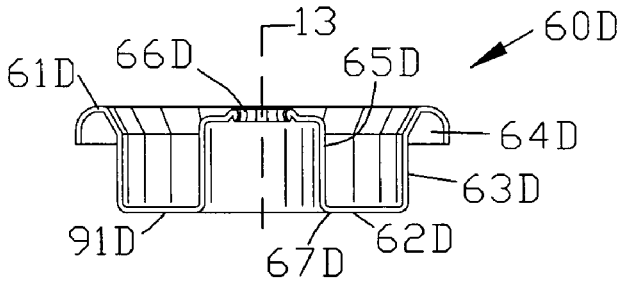
FIG. 27 is a sectional view along line 27-27 in FIG. 26.

FIGS. 25-27 illustrate enlarged views of a fifth embodiment of an improved mounting cup 60D of the present invention shown in FIGS. 1-4. The mounting cup 60D extends between a first end 61D and a second end 62D interconnected by a sidewall 63D. The sidewall 63D is substantially coaxial with the axis of symmetry 13 with a cross-section of the sidewall 63D being substantially parallel to the axis of symmetry 13 at shown in FIG. 27.

The second end 62D of the improved mounting cup 60D defines a bottom wall 67D. The bottom wall 67D is substantially perpendicular to the axis of symmetry 13 with a cross-section of the bottom wall 67D being substantially perpendicular to the axis of symmetry 13 as shown in FIG. 27.

The sealing surface 91D of the fifth embodiment of the improved mounting cup 60D is incorporated into the bottom wall 67D of the improved mounting cup 60D. The sealing surface 91D is shown as a generally circular ring on the bottom wall 67D of the improved mounting cup 60D.

Figure 27A:
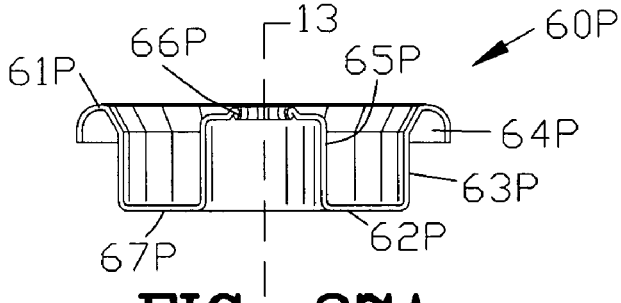
FIG. 27A is a sectional view similar to FIG. 27 of a mounting cup of the prior art.

FIG. 27A illustrates a mounting cup 60P of the prior art. The mounting cup 60P extends between a first end 61P and a second end 62P. A sidewall 63P interconnects the first end 61P with a second end 62P. The second end 62P of the mounting cup 60P defines a bottom wall 67P. The sidewall 63P is substantially coaxial with the axis of symmetry 13 whereas the bottom wall 67P is substantially perpendicular to the axis of symmetry 13.

In contrast to the mounting cup 60P of the prior art, the improved mounting cup 60D of the present invention provides a sealing surface 91D on the bottom wall 67D of the improved mounting cup 60D to define a circular sealing surface 91D substantially coaxial with the axis of symmetry 13. The circular surface 91D is located between the turret 65D and the sidewall 63D of the improved mounting cup 60D. The circular sealing surface 91D provides a surface for attaching the collapsible container 80 to the improved mounting cup 60D.

Figure 28:
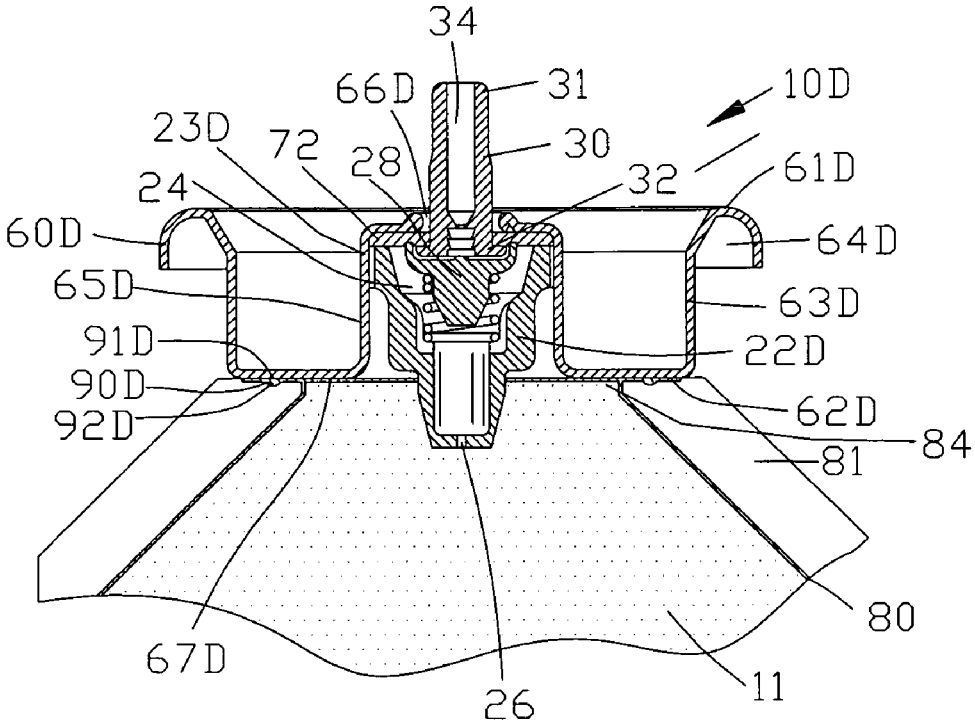
FIG. 28 is a sectional view of the improved mounting cup of FIGS. 25-27 secured to the collapsible container.

FIG. 28 is a sectional view of the improved mounting cup 60D of FIGS. 25-27 secured to the collapsible container 80. The top portion 81 of the collapsible container 80 is sealed to form a container opening 84 suitable for securing to the circular surface 91D. A bond 92D affixes the container opening 84 of the collapsible container 80 to the circular surface 91D of the mounting cup 60D.

In this embodiment of the invention, the valve body 22D is provided with castellation 23D located about the outer periphery of the valve body 22D. The castellation 23D provide flow paths for aerosol product 11 through the castellation 23D located about the outer periphery of the valve body 22D into the collapsible container 80.

Figure 29:
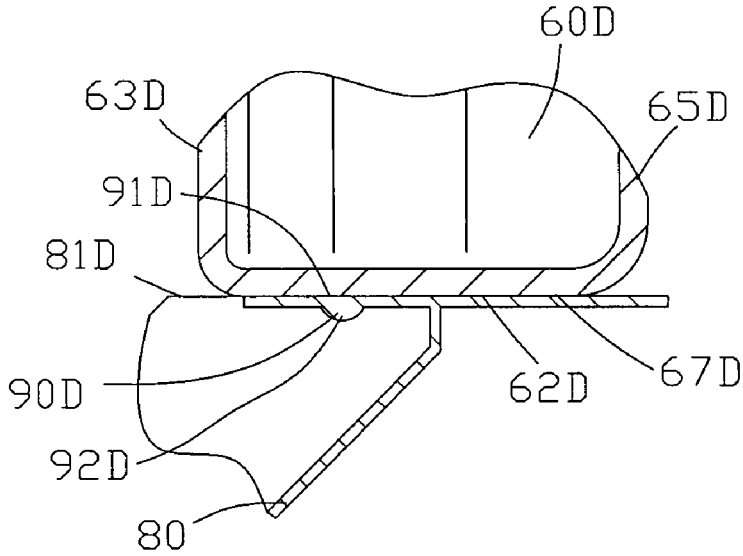
FIG. 29 is an enlarged view of a portion of FIG. 28.

FIG. 29 is an enlarged view of a portion of FIG. 28 further illustrating the bond 92D between the improved mounting cup 60D and the collapsible container 80. In this example, the collapsible container 80 is shown as a metallic collapsible container 80 secured directly to a metallic mounting cup 60D by the bond 92D. The bond 92D may comprise a weld, a radio frequency weld, laser weld, an adhesive, a mechanical fastener such as mechanical clamps, friction or by any other suitable means. In the alternative, the bond 92D may comprise any of the bond previously set forth herein or any other suitable bond.

Preferably the improved aerosol dispenser 10 is assembled in one of the following manners. The collapsible container 80 is in an unfilled and collapsed condition for enabling the collapsible container 80 to be inserted through the container opening 57 into the aerosol container 50. The collapsible container 80 may be rolled about a sleeve (not shown) for enabling insertion into the aerosol container 50.

The peripheral rim 64 of the mounting cup 60 is crimped to the bead 56 of the aerosol container 50 in a conventional fashion. The rim gasket 71 provides a fluid tight seal between the peripheral rim 64 of the mounting cup 60 and the bead 56 of the aerosol container 50.

The aerosol product 11 is introduced into the collapsible container 80. In one example, the aerosol product 11 is introduced into the collapsible container 80 through the stem passageway 34 of the valve stem 30. The movement of the valve stem 30 displaces the valve elements 28 from the valve gasket 72 to enable the flow of the aerosol product 11 into the collapsible container 80. The collapsible container 80 expands within the aerosol container 50 as the aerosol product 11 fills the collapsible container 80.

In another example, the valve stem 30 is depressed and the aerosol product 11 is introduced into the collapsible container 80 around the outer surface 33 of the valve stem 30 and through the aperture 66 in the turret 65. The pressure of the aerosol product 11 displaces and/or compresses the valve gasket 72 to enable the flow of the aerosol product 11 through the castellation 23D located about the outer periphery of the valve body 22D into the collapsible container 80. The collapsible container 80 expands within the aerosol container 50 as the aerosol product 11 fills the collapsible container 80.

In still another example, the aerosol product 11 is introduced into the collapsible container 80 around the valve body 22 of the aerosol valve 20. The aerosol product 11 flows through an orifice (not shown) within the mounting cup 60 over the valve gasket 72 and around the outer periphery of the valve body 22. The pressure of the aerosol product 11 displaces the valve elements 28 from the valve gasket 72 to enable the flow of the aerosol product 11 into the collapsible container 80. The collapsible container 80 expands within the aerosol container 50 as the aerosol product 11 fills the collapsible container 80.

The propellant 12 is introduced into the aerosol container 50 through the filling aperture 59 located in the endwall 58 of the aerosol container 50. After the propellant 12 is introduced into the aerosol container 50 through the filling aperture 59, the filling aperture 59 is sealed by the plug 59A. The propellant 12 provides external pressure to the collapsible container 80 for discharging the aerosol product 11 through the terminal orifice 42. In the alternative, the aerosol container 50 may be filled with the aerosol propellant 12 through an under the cup filling process as previously described.

One important benefit of the improved mounting cup 10 of the present invention is the ability to fill the aerosol product 11 into the collapsible container 80 around the valve body 22 of the aerosol valve 20. This method of filling an aerosol container with an aerosol product 11 is commonly referred to as a high speed pressure filling process.

Another important aspect of the improved mounting cup 10 of the present invention is the incorporation of the flexible collapsible container 80 containing the aerosol product 11 with the aerosol propellant 12 being contained within the aerosol container 50. The present invention enables the aerosol valve 20 to be completely isolated from the aerosol propellant 12. Accordingly, any aerosol valve 20 may be used with any propellant 12 in the present invention. Furthermore, the attachment of the collapsible container 80 to the improved mounting cup 60 inhibits the permeation of the propellant 12 through the valve body 22 of the aerosol valve 20.

The aerosol dispensing device 10 of the present invention enables the aerosol product 11 to be dispensed in any of a three hundred and sixty degree orientation. The three hundred and sixty degree dispensing capability is the result of the uniform pressure applied to the collapsible containers 80 by the aerosol propellant 12. The aerosol dispensing device 10 is suitable also for dispensing products in a downward direction through the use of an appropriate actuator 40. Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved dispenser for dispensing an aerosol product with an aerosol propellant located within an aerosol container, the aerosol container having a bead defining an opening in the aerosol container, comprising:

a mounting cup comprising by a sidewall, a peripheral rim, a bottom wall and a central turret formed as a one-piece unit;

said central turret defining an axis of symmetry of said mounting cup;

an aerosol valve secured within said turret of said mounting cup;

said peripheral rim located radially outward of said turret of said mounting cup;

said sidewall having a first region adjacent to said peripheral rim and having a second region adjacent to said bottom wall of said mounting cup;

said first region of said sidewall being generally cylindrical having a cylindrical axis substantially coaxial with the axis of symmetry of said mounting cup;

said second region of said sidewall being generally cylindrical having a cylindrical axis substantially coaxial with the axis of symmetry of said mounting cup to provide a mounting surface;

a collapsible container for containing the aerosol product;

a bond for sealing the collapsible container to said mounting surface of said mounting cup;

said bond sealing the collapsible container located only to said mounting surface;

said second region of said sidewall being located radially inwardly relative to said first region of said sidewall a distance sufficient to provide clearance for inserting the mounting cup and the attached collapsible container through the opening defined by the bead of the aerosol container; and said peripheral rim of said mounting cup adapted to be sealed to the bead of the aerosol container for enabling the aerosol propellant located within the aerosol container to apply pressure to said collapsible container to collapse said collapsible container upon an open of said aerosol valve to dispense the aerosol propellant from said collapsible container through said aerosol valve.

2. An improved mounting cup for dispensing an aerosol product as set forth in claim 1, wherein said mounting surface comprises a cylindrical surface having a cylindrical axis coincident with an axis of symmetry of said mounting cup.

3. An improved mounting cup for dispensing an aerosol product as set forth in claim 1, including a polymeric bond material for sealing the collapsible container to said mounting cup.

4. An improved mounting cup for dispensing an aerosol product as set forth in claim 1, including a first polymeric bond material located on said mounting surface of said mounting cup;

a second polymeric bond material located on the collapsible container; and said first polymeric bond material bonding with said second polymeric bond material for sealing the collapsible container to said mounting cup.

5. An improved mounting cup for dispensing an aerosol product as set forth in claim 1, including a first polymeric bond material located on said mounting surface of said mounting cup;

a second polymeric bond material located on the collapsible container; and said first polymeric bond material being sonically bonded to said second polymeric bond material for sealing the collapsible container to said mounting cup.

6. An improved mounting cup for dispensing an aerosol product as set forth in claim 1, including a first polymeric bond material located on said mounting surface of said mounting cup;

a second polymeric bond material located on the collapsible container; and said first polymeric bond material being heat sealed to said second polymeric bond material for sealing the collapsible container to said mounting cup.

7. An improved mounting cup for dispensing an aerosol product as set forth in claim 1, including a first polymeric bond material laminated on said mounting surface of said mounting cup;

a second polymeric bond material located on the collapsible container; and said first polymeric bond material bonding to said second polymeric bond material for sealing the collapsible container to said mounting cup.

8. An improved dispenser for dispensing an aerosol product with an aerosol propellant located within an aerosol container, the aerosol container having a bead defining an opening in the aerosol container, comprising:

a mounting cup comprising a sidewall, a peripheral rim, a bottom wall and a central turret formed as a one-piece unit;

said central turret defining an axis of symmetry of said mounting cup;

said peripheral rim located radially outward of said turret of said mounting cup;

an aerosol valve secured within said turret of said mounting cup;

said bottom wall of said mounting cup being substantially perpendicular the axis of symmetry of said mounting cup;

said sidewall having a first region adjacent to said peripheral rim and having a second region adjacent to said bottom wall of said mounting cup;

said first region of said sidewall being generally cylindrical having a cylindrical axis substantially coaxial with the axis of symmetry of said mounting cup;

said second region of said sidewall being generally cylindrical having a cylindrical axis substantially coaxial with the axis of symmetry of said mounting cup to provide a mounting surface;

a collapsible container for containing the aerosol product;

a bond for sealing the collapsible container to said mounting surface of said mounting cup;

said bond sealing the collapsible container located only to said mounting surface;

said second region of said sidewall being located radially inwardly relative to said first region of said sidewall a distance sufficient to provide clearance for inserting the mounting cup and the attached collapsible container through the opening defined by the bead of the aerosol container; and said peripheral rim of said mounting cup adapted to be sealed to the bead of the aerosol container for enabling the aerosol propellant located within the aerosol container to apply pressure to said collapsible container to collapse said collapsible container upon an open of said aerosol valve to dispense the aerosol propellant from said collapsible container through said aerosol valve.

9. An improved dispenser for dispensing an aerosol product with an aerosol propellant located within an aerosol container, the aerosol container having a bead defining an opening in the aerosol container, comprising:

a mounting cup comprising a sidewall, a peripheral rim, a bottom wall and a central turret formed as a one-piece unit;

said central turret defining an axis of symmetry of said mounting cup;

an aerosol valve secured within said turret of said mounting cup;

said peripheral rim located radially outward of said turret of said mounting cup;

said bottom wall of said mounting cup being substantially perpendicular the axis of symmetry of said mounting cup;

said sidewall being generally cylindrical having a cylindrical axis substantially coaxial with the axis of symmetry of said mounting cup;

a projection extending from said bottom wall of said mounting cup defining a sealing surface;

said sealing surface defining a generally cylindrical surface substantially coaxial with the axis of symmetry of said mounting cup;

a collapsible container for containing the aerosol product;

a bond for sealing the collapsible container to said sealing surface of said mounting cup;

said bond sealing the collapsible container located only to said sealing surface;

said projection being located radially inwardly relative to said sidewall a distance sufficient to provide clearance for inserting the mounting cup and the attached collapsible container through the opening defined by the bead of the aerosol container; and said peripheral rim of said mounting cup adapted to be sealed to the bead of the aerosol container for enabling the aerosol propellant located within the aerosol container to apply pressure to said collapsible container to collapse said collapsible container upon an open of said aerosol valve to dispense the aerosol propellant from said collapsible container through said aerosol valve.

* * * * *